United States Patent [19]

Smead

[11] Patent Number: 4,489,893

[45] Date of Patent: Dec. 25, 1984

[54] ELECTROSTATIC SPRAY GUN

[75] Inventor: Robert G. Smead, St. Charles, Ill.

[73] Assignee: Caterpillar Tractor Co., Peoria, Ill.

[21] Appl. No.: 498,363

[22] Filed: May 26, 1983

[51] Int. Cl.[3] ..... B05B 5/00

[52] U.S. Cl. ..... 239/691; 239/288; 239/707

[58] Field of Search ..... 239/706, 707, 691

[56] References Cited

U.S. PATENT DOCUMENTS 2,959,353 11/1960 Croskey et al. ..... 239/707

3,613,993 10/1971 Gourdine et al. ..... 239/707 X 4,258,655 3/1981 Bagby et al. ..... 239/707 X

*Primary Examiner*—Andres Kashnikow

*Assistant Examiner*—Mary F. McCarthy

*Attorney, Agent, or Firm*—Robert A. McFall

[57] ABSTRACT

An electrostatic spray gun (10) for the spray application of electrically conductive materials includes a shield (24) to prevent the build-up of electrically conductive flash deposits on preselected non-conductive surface areas (26) of the gun (10). By prohibiting the build-up of electrically conductive flash on preselected areas of the gun surface, the shield (24) is effective in preventing the completion of an electrical circuit between a charged electrode (18) and an electrically grounded gun support member (22). The gun of the present invention is particularly effective in the high volume spray deposition of electrically conductive paints.

5 Claims, 2 Drawing Figures

ELECTROSTATIC SPRAY GUN

DESCRIPTION

Technical Field

This invention relates generally to a fluid sprinkling spraying or diffusing apparatus and more particularly to an electrostatic spray gun for spraying electrically conductive materials.

Background Art

The use of water-base and other electrically conductive paints in electrostatic spray applications presents a number of problems not encountered with non-conductive spray materials. For example, the normal deposition of flash on external surfaces of the spray apparatus during the spraying of non-conductive materials does not present any particularly serious problems. However, if the flash, or surface film, comprises electrically conductive material, great care must be exercised to prevent the establishment of an electrically conductive path between the charging elements of the electrostatic spray apparatus and ground. On occasion, the rate of current flow between the electrode and ground, along the path provided by the dried primer paint, can be sufficient to generate heat and cause combustion of the spray material. In the past this has been accomplished primarily by the frequent and careful removal of the conductive flash deposits from the external surfaces of the spray apparatus before the deposits accumulate sufficiently to form an electrical circuit between the charging elements and a grounded surface. Alternatively, support structures and mounting fixtures for spray guns have been constructed of electrically non-conductive materials.

Neither of the above attempts to prevent electrode grounding during the spraying of electrically conductive materials have been completely satisfactory. Frequent cleaning of the spray guns, mounting brackets and support fixtures is laborious and costly. Generally, strong cleaning agents must be used to remove dried deposits and, depending on the severity of the problem, a considerable amount of apparatus down-time is required for the cleaning operation. The use of electrically non-conductive mounting brackets and support fixtures may extend the time period between the required cleaning operations, but eventually these surfaces may also accumulate a flash coat of spray material sufficient to form an electrical circuit to ground.

The present invention is directed to overcoming one or more of the problems set forth above by providing a shield to protect preselected surface areas of the spray apparatus from deposition of the electrically conductive material and hence preclude the completion of an electric circuit between the charged electrodes and a grounded element of the apparatus.

Disclosure of the Invention

In accordance with one aspect of the present invention an electrostatic spray gun having a nozzle at a forward end of the gun for spraying an electrically conductive material, an electrode spaced from the nozzle, and a support member connected to the gun at a position rearwardly of the gun, includes means for mounting the electrode on the support member and a shield that is positioned between the electrode and the support member. The shield is arranged to protect a preselected non-conductive surface portion of the gun from deposition of the electrically conductive material and thereby preclude the completion of an electrical current between the electrode and the support member.

The present invention overcomes the above problem by shielding a non-conductive portion of the gun surface from the deposition of flash. By maintaining the non-conductive characteristics of an appropriate surface area of the gun, it is now possible to effectively prevent the establishment of an electrical circuit resulting from flash build-up.

Figure 1:
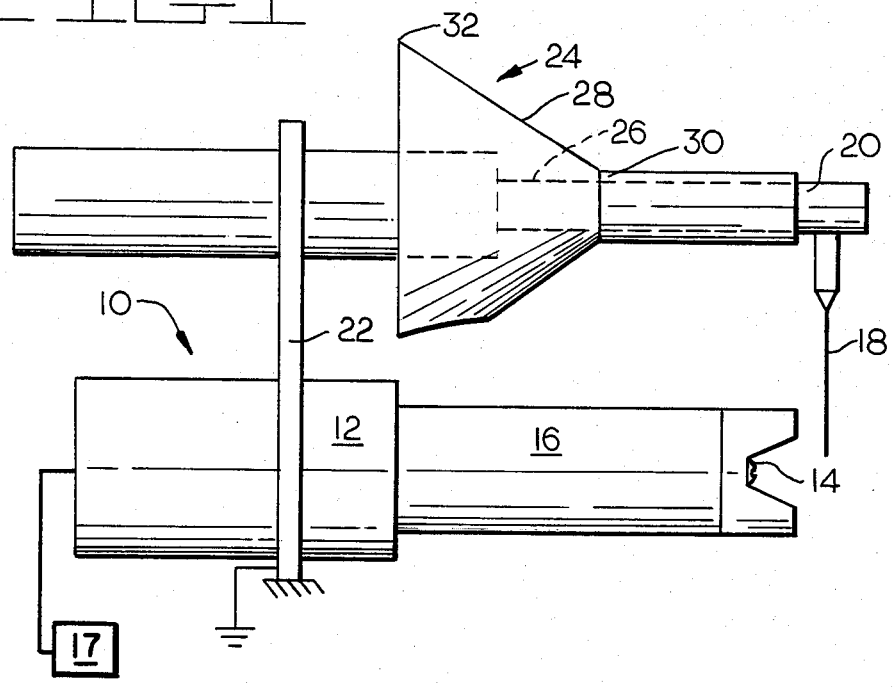
FIG. 1 is an elevational view of an electrostatic spray gun which is one embodiment of the present invention.
Figure 2:
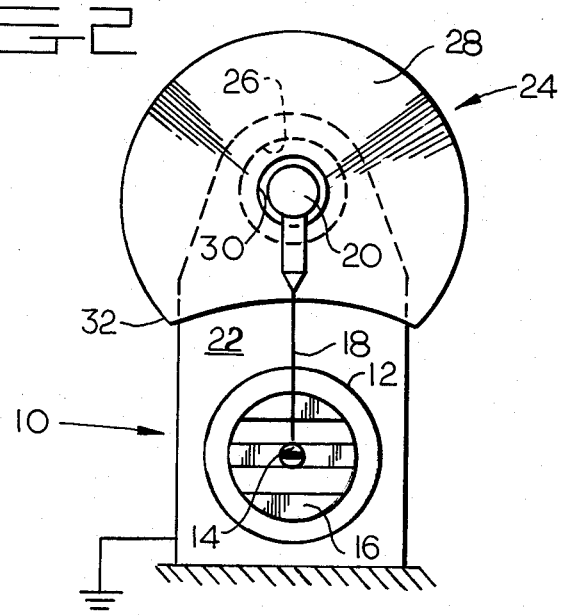
FIG. 2 is an end view as seen from the right of FIG. 1.

Best Mode for Carrying Out the Invention

In a preferred embodiment, an electrostatic spray gun 10 has a central body portion 12, and a nozzle 14 disposed at a forward end 16 of the body portion 12 for spraying an electrically conductive material supplied from a source 17 onto a workpiece, not shown. The spray gun 10 also includes an electrode 18 spaced from the nozzle 14, and means for mounting the electrode 18 on an electrically grounded support member 22 at a position spaced from the electrode 18. In the present embodiment the means is in the form of an outwardly extending arm 20. The support member 22 is also attached to the body portion 12 at a position spaced rearwardly from the nozzle 14. Portions of the external surface of the gun 10 are constructed of an electrically non-conductive material such as polyethelene. In particular, the exterior surfaces of the electrode mounting arm 20 is formed of a non-conductive material.

The spray gun 10 also includes a shield 24 positioned between the electrode 18 and the support member 22. The shield 24 is preferably constructed of an electrically non-conductive material such as polyethelene and is of a construction sufficient for protecting a preselected non-conductive surface portion 26 of the gun 10 from deposition of the sprayed electrically conductive material during the operation of the gun. In the preferred embodiment, the shield 24 includes a substantially frustoconical surface 28 extending between a first end 30 that intimately surrounds the electrode mounting arm 20 and a second end 32 that is spaced from the arm 20. The internal diameter of the first end 30 is substantially the same as the outer diameter of the electrode mounting arm 20 and the resultant snug fit between the two members serves to support the shield 24 in a fixed position on the arm 20. The diameter, or outer extremity, of the second end 32 of the shield 24 has a dimension and shape sufficient to provide an air gap, or space, between the shield 24 and proximate surfaces of the electrode mounting arm 20, the body portion 12, and the support member 22. In the preferred embodiment, it has been found that an air gap, or space, between the shield 24 and the surrounding surfaces of the gun of about one inch (2.5 cm) is sufficient to preclude a build-up of electrically conductive flash on the preselected surface portion 26 of the gun 10 and thereby prevent the formation of an electrical circuit between the electrode 18 and the support member 22.

It has been found that it is only necessary to shield the area 26 on the electrode mounting arm 20 to prevent flash build-up and the consequent formation of an electrical circuit between the electrode and ground. Other electrode mounting arrangements or gun configurations may require modification of the size or shape of the shield 24. For example, if the electrode is mounted so that it projects from the body portion 12 of the gun 10 rather than from a separate mounting arm 20, it may be desirable to mount the shield 24 directly on the gun body 12. In such an embodiment, the first end 30 of the shield would normally circumscribe the body portion 12, and the second end 32 of the shield 24 would be spaced both from the body portion 12 and the support member 22.

In yet another arrangement, the gun 10 may include an intermediate mounting fixture constructed of a non-conductive material for mounting the gun 10 onto a spaced, but operatively connected, grounded support member 22. In such an arrangement, the shield 24 may be mounted on the intermediate mounting fixture and the resultant preselected area 26 would be a surface area on the non-conductive mounting fixture.

Industrial Applicability

The electrostatic spray gun of the present invention has been successfully used to apply an electrically conductive primer paint to automotive body parts. The primer used in this application is highly conductive when dry. It was found that even completely stripping the flash build-up from the gun at strictly enforced periodic intervals was insufficient to prevent an accumulation of flash on the gun surfaces in an amount sufficient to form an electrical circuit between the electrode 18 and the closest grounded conductive member, which in this particular instance was the gun support member 22. In particular, before use of the present invention it was noticed that flash deposits were particularly heavy along the upper surface of the electrode mounting means 20 and cleaning of the gun was required at one-hour intervals. Even the frequent cleaning of these surfaces, however, was not always effective in preventing the build-up of a conductive flash coat on the upper surfaces.

After installation of the shield member 24 on the same spray gun, the build-up of flash, particularly in the preselected area 26 on the electrode mounting arm 20 was effectively prevented. It was found that the cleaning time for the removal of flash build-up could be extended from one hour to four hours. Further, there have been no instances of heat generation on the gun surfaces due to current flow through dried flash deposits.

Other aspects, features and advantages of this invention can be obtained from a study of the drawings, the disclosure and the appended claims.

I claim:

1. In an electrostatic spray gun (10) having a nozzle (14) at a forward end (16) of said gun (10) for spraying an electrically conductive material therefrom, a source (17) of said electrically conductive material, an electrode (18) spaced from said nozzle (14), and an electrically grounded support member (22) operatively connected to said gun (10) at a position rearwardly of said nozzle (14), the improvement comprising:

means (20) for mounting the electrode (18) on the support member (22); and shield means (24) positioned between said electrode (18) and said grounded support member (22) for protecting a preselected electrically non-conductive surface portion (26) of the gun (10) from deposition of the electrically conductive material and hence precluding the completion of an electrical circuit between said electrode (18) and said support member (22).

2. The electrostatic spray gun (10), as set forth in claim 1, wherein said shield (24) includes a first end (30) in contact with said electrode mounting means (20), a second end (32) spaced from said electrode mounting means (20), and a generally frustoconical surface portion (28) extending between said first and second ends (30,32).

3. An electrostatic spray gun (10) for spraying electrically conductive material, comprising:

a body portion (12);

a nozzle (14) disposed at a forward end (16) of said body portion (12);

a source (17) of electrically conductive material;

an electrode (18) spaced from said nozzle (14);

an electrically grounded support member (22) connected to said body portion (12) at a position spaced rearwardly from said nozzle (14);

means (20) for mounting said electrode (18) on said support member (22); and shield means (24) disposed between said electrode (18) and said support member (22) and being of a construction sufficient for protecting a preselected non-conductive surface portion (26) of the gun (10) from deposition of the electrically conductive material during the operation of said gun (10).

4. The electrostatic spray gun (10), as set forth in claim 3, wherein said shield (24) includes a substantially frustoconically shaped surface (28) extending between spaced first and second end portions (30,32) of said shield (24), said second end portion (32) being spaced from said electrode mounting means (20), said body portion (12), and said support member (22) at a distance sufficient to prevent the formation of an electrically conductive circuit by said electrically conductive material between said shield (24) and said support member (12).

5. The electrostatic spray gun (10), as set forth in claim 4, wherein the second end (32) of said shield is spaced a distance of at least one inch (2.5 cm) from said electrode mounting means (20), said body portion (12), and said support member (22).

* * * * *